United States Patent [19]

Miller

[11] 4,044,704

[45] Aug. 30, 1977

[54] SAUCER BOAT

[76] Inventor: Gerald R. Miller, R.R. No. 4 Box 64A, Arkansas City, Kans. 67005

[21] Appl. No.: 700,316

[22] Filed: June 28, 1976

[51] Int. Cl.[2] ..... B63H 11/04

[52] U.S. Cl. ..... 115/12 R; 114/151

[58] Field of Search ..... 115/12 R; 9/1.3; 114/151; 60/222, 229

[56] References Cited

U.S. PATENT DOCUMENTS

| | | | |
|---|---|---|---|
| 37,710 | 2/1863 | Smith | 115/12 R |
| 2,330,674 | 9/1943 | Briggs | 114/151 |
| 3,132,477 | 5/1964 | Egger | 115/12 R |
| 3,391,669 | 7/1968 | Buster | 9/1.3 X |
| 3,835,806 | 9/1974 | Rice | 60/229 X |
| 3,911,851 | 10/1975 | Canazzi | 60/222 |

*Primary Examiner*—Trygve M. Blix

*Assistant Examiner*—Gregory W. O'Connor

*Attorney, Agent, or Firm*—Head, Johnson & Chafin

[57] ABSTRACT

A circular saucer boat which is adapted to be driven by means of a plurality of water jets through prepositioned pipes leading to openings directed radially in four perpendicular directions. The boat comprises a circular framework which is covered by a thin skin which seals the exposed surface of the boat. A circular opening at the top provides space for occupants. An engine and hydraulic pump are provided for generating a flow of sea water which is discharged from the pump through one or more of four pipes leading to the four openings. There are valves in each of the four lines which can be controlled individually or in combination. Speed control can be by the throttle of the engine, or by control of valves which open the pipes to a greater or lesser flow of water.

6 Claims, 9 Drawing Figures

SAUCER BOAT

BACKGROUND OF THE INVENTION

This invention lies in the field of small boats. More particularly, this invention lies in the field of boats driven by water jets. Still more particularly, this invention concerns a boat of circular construction which can be driven in any selected direction by providing a plurality of pipes radially projecting from the hull in a plurality of directions, so that by control of valves, jets of water can be ejected from the hull in any selected direction so as to drive the boat in the opposite direction.

In the prior art, it has been known to drive a boat by means of a water jet. In general, the boats have been of the conventional type, that is, with a pointed prow, and the jet has been controlled to issue in a longitudinal direction from the stern, so that the boat is propelled in the normal direction of the pointed prow. Furthermore, the boats using the jet have been guided by a swivel portion of the conduit which carries the jet, so that by varying the angle of the jet with respect to the axis of the boat to the right or to the left corresponding turns can be made to the right or to the left respectively.

The type of operation just described, that is with a conventional shaped boat, and a single jet, is difficult to maneuver in close quarters, and therefore, the conventional system of jet propulsion for a conventional boat has a serious disadvantage.

It is therefore a primary object of this invention to provide a boat having nondirectional characteristics, and to provide a plurality of fixed orifices directed radially, at various angles symmetrically positioned around the boat. Consequently, by simple control of valves which switch the output from a hydraulic pump to one or another of the radial orifice outlets, the boat can be changed in direction with great speed and convenience.

It is a further object of this invention to provide a plurality of radial pipes with valves to control the flow of water to one or more of the pipes plus the addition of at least two pipes directed tangential to the construction of the boat, so that by valving a stream of water through one or the other of two opposed jets, the boat can be rotated about its own axis.

It is a further object of this invention to provide a circular saucer-type boat with two conduits to provide jets directed to the rear and to the front of positions in which the occupants can be seated, and to provide additional conduits for jetting water in a tangential direction to the right hand or to the left hand, in order to rotate the boat and therefore change direction.

SUMMARY OF THE INVENTION

These and other objects are realized and the limitations of the prior art are overcome in this invention by providing a boat of circular construction, in the form of a saucer, with space in the center of the boat for occupants and space for an engine and a hydraulic pump, with means for pump intake under the bottom of the boat, and a plurality of pipes on the outlet of the pump, the terminations of the various pipes being in radial direction symmetrically distributed about the vertical axis of the boat. A plurality of valves are provided which are controlled by individual knobs so that one or more of the valves can be opened simultaneously providing one or more jets of water issuing radially from the boat and acting to move the boat in a direction opposite to the direction of the jet or jets of water.

Means are provided also for pipes to be directed tangential to the circumference of the boat, with proper control, so that tangential jets of water can be provided for rotating the boat about its vertical axis.

BRIEF DESCRIPTION OF THE DRAWINGS

These and other objects and advantages of this invention and a better understanding of the principals and details of the invention will be evident from the following description, taken in conjunction with the appended drawings, in which.

DESCRIPTION OF THE PREFERRED EMBODIMENT

Figure 1:
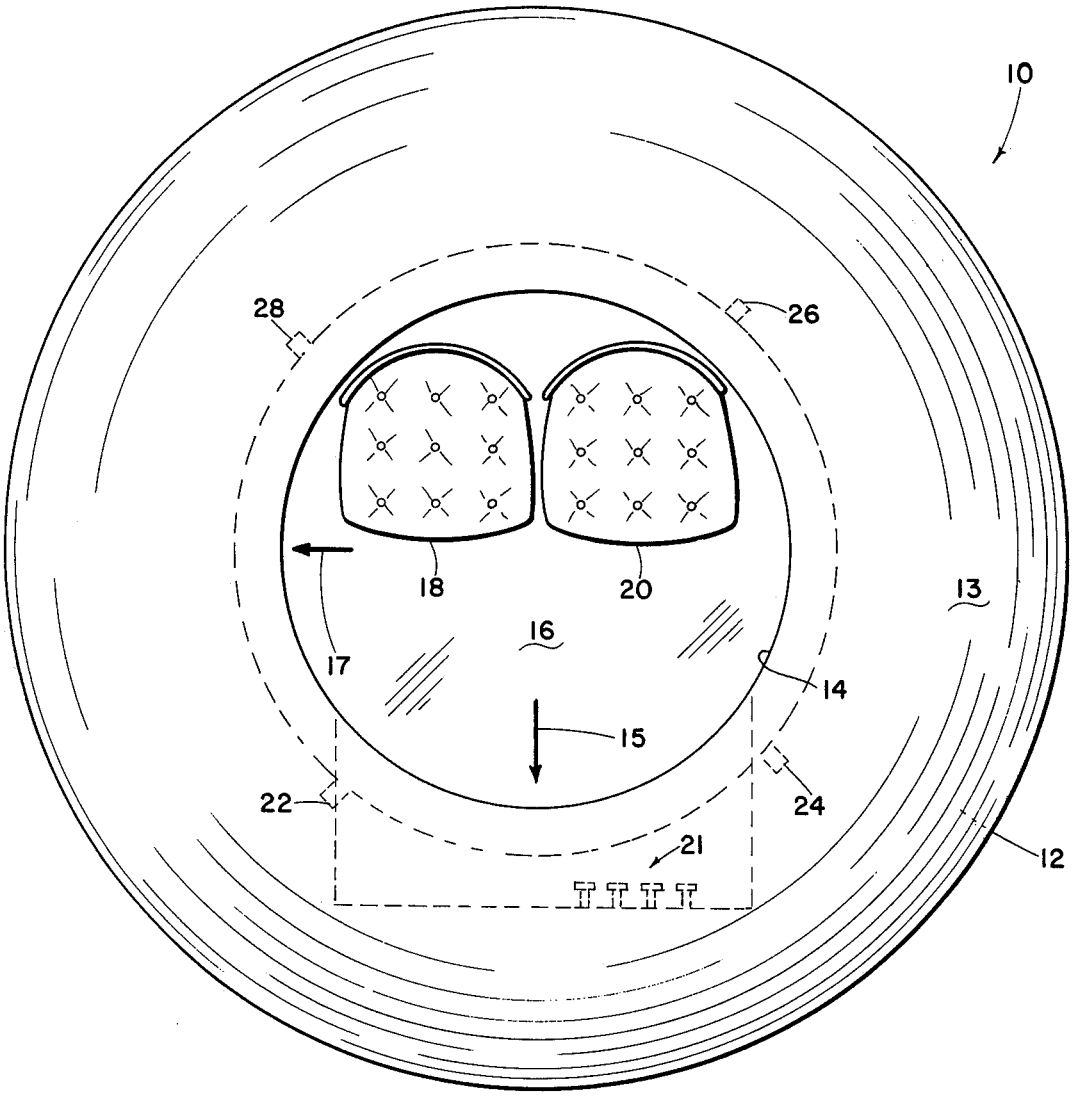
FIGS. 1 and 2 represent exterior views of one embodiment of this invention.
Figure 2:
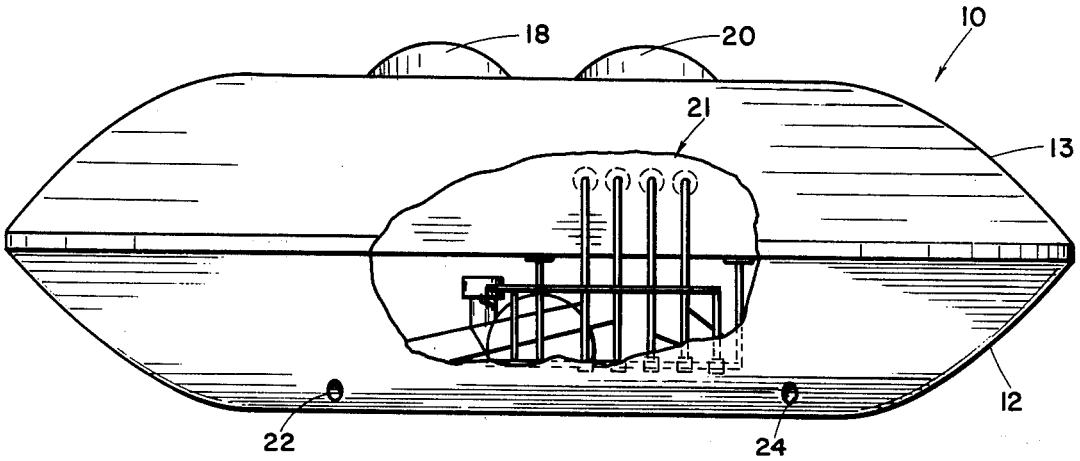

Referring now to the drawings and in particular to FIGS. 1 and 2, there is shown one embodiment of this invention which comprises a saucer boat which in plan view is circular, and in elevation view has a lower portion 12 which is similar to a saucer and an upper portion 13 of the hull which is similar to an inverted saucer, with a circular axial cavity in which the occupants are seated.

Figure 3:
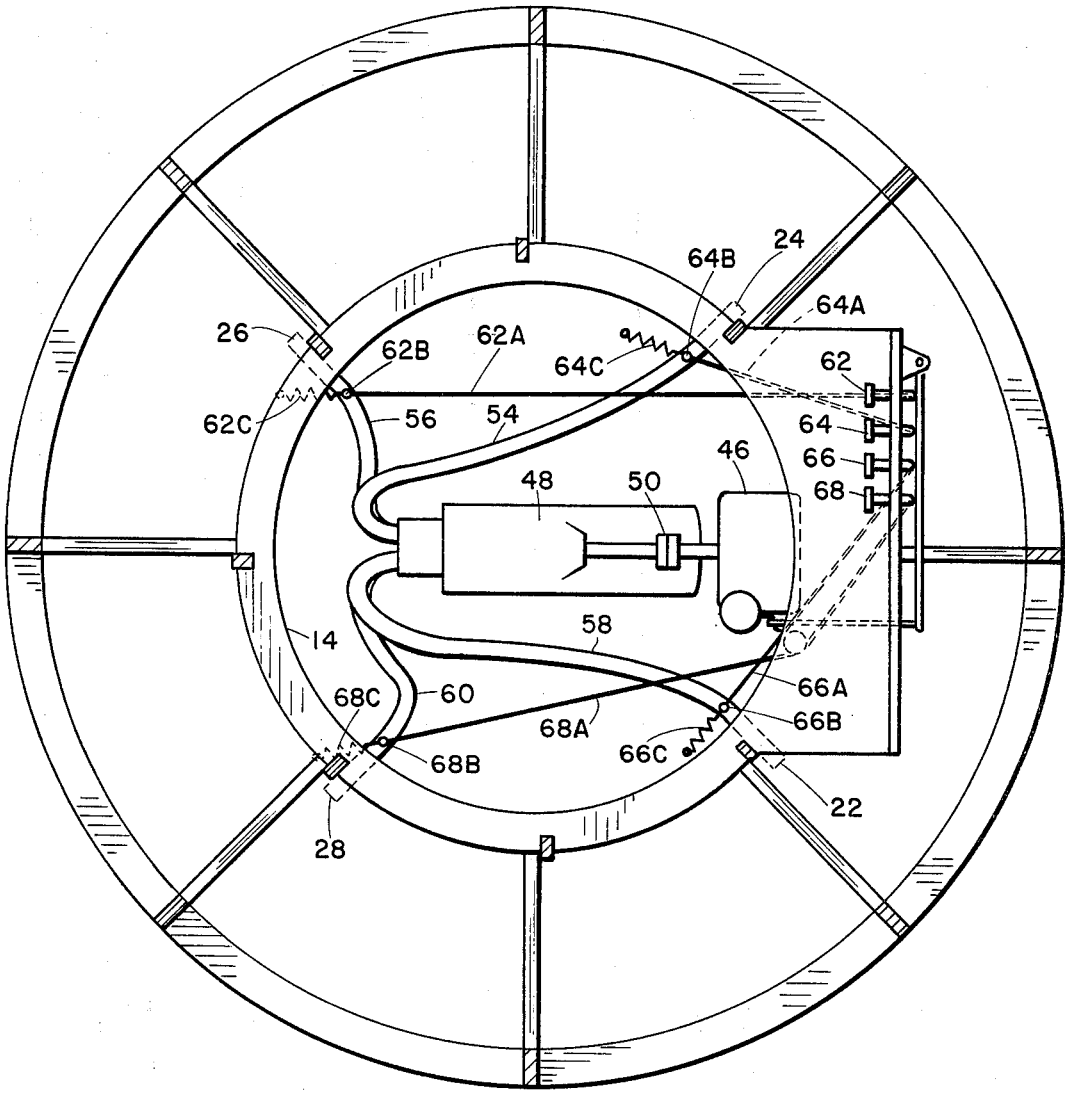
FIGS. 3 and 4 illustrate in partial cross-section plan elevation views of one embodiment of this invention.
Figure 4:
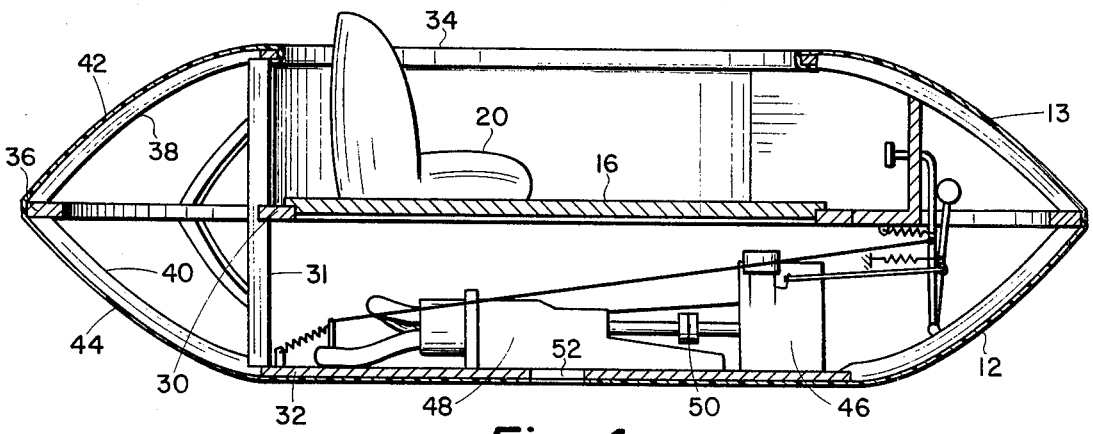

The boat indicated generally by the numeral 10 has, as shown in FIGS. 3 and 4, a framework which can be constructed in any well known manner, of circular rings and vertical columns, with struts of the proper shape, and so forth, covered by a thin skin of material 44 on the bottom, and a corresponding skin 42 on the top portion. A central circular plate 32 is provided at the bottom with an opening 52 to provide inlet to the hydraulic pump 48 which is mounted to the bottom plate 32. There is an engine 46 mounted on the plate 32 with a coupling 50, which can be an electrical coupling, or a disc coupling, as desired. Two circular rings 30 and 34 are provided which, with uprights 31, define the central opening. The seats 20 can be mounted on a circular plate 16 which rests on the ring 30. The plate and seat etc. can be removed to expose the engine, pump and valve system, in the lower portion of the hull.

A larger ring 36 defines the maximum diameter of the boat, and is supported at the approximately vertical center plane by means of ribs 38 and 40, for example, or other equivalent means. The ring 36 and ribs 38 and 40 support the skin 44 on the bottom portion and 42 on the top portion. Various materials such as wood, metal, plastic, fiberglass, etc. or other materials, well known in the art of construction of small boats can be used in the fabrication of the boat. The particular details of the construction form no part of the invention which is concerned primarily with the propulsion system.

There are four pipes shown issuing from the outlet of the pump 48. These are 54, 56, 58 and 60, and they are directed to outlets 24, 26, 22 and 28 respectively which appear at the outer skin 44 of the boat. Each of the pipes has a valve, such as 62B, 64B, 66B, 68B, one in each of the pipes, which are controlled respectively by controls or plungers 62, 64, 66 and 68 respectively.

Figure 5:
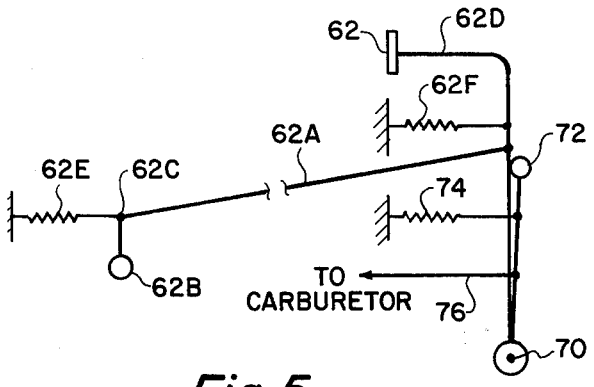
FIGS. 5 and 6 illustrate details of the valves and controls.
Figure 6:
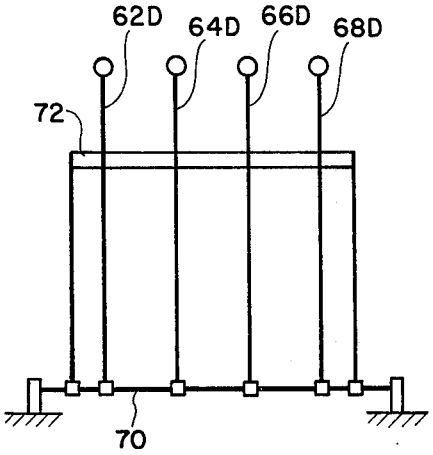

As shown in FIGS. 5 and 6, one way of constructing the controls is to provide a valve in the pipe such as 62B, for example, with an operating lever 62C which is controlled by a cord or cable 62A which is tied to the control 62 which is in the form of a bent rod 62D which is rotatable about an axis 70, which is fastened to the boat frame by any well known means. Each bent rod is restrained by a spring such as 62F, etc. A spring 62E is provided to keep the lever 62C in a closed position at all times except when the control 62 is moved forward. The support rod 62D then moves forward, pulling on the cable 62A and opening the valve by moving the lever 62C against the force of the spring 62E.

Also, rotatable about the shaft or axis 70, is a control arm 72 which is held by spring 74 against the rods 62D, 64D, 66D, and 68D. Therefore, when any one or more of the controls 62, 64, 66 or 68 are pushed forward against their holding spring, such as 62F, for example, then the rod 72 will also be moved forward against its own spring 74 and by means of the cable 76, which is connected to the carburetor, the throttle will be increased on the engine in order to provide the needed power to drive the pump and to transport the boat. Of course, an additional control can be provided onto the rod 72, independent of the operation of the controls 62 to 68.

One method of driving the boat as illustrated in FIG. 1 is to create two jets of water out of the opening 26 and 28, for example, to drive the boat in the direction of the arrow 15. To reverse the direction, jets would be stopped from the openings 26 and 28 and would be set up in the openings 24 and 22. This would provide a thrust to the rear which would slow down the boat, stop it, then reverse the boat in the direction opposite to arrow 15.

Correspondingly, by creating jets through the outlets 24 and 26, it would move the boat in the direction of the arrow 17. Conversely, if the jets were at the openings 22 and 28, both would move in a direction opposite to arrows 17.

Figure 7:
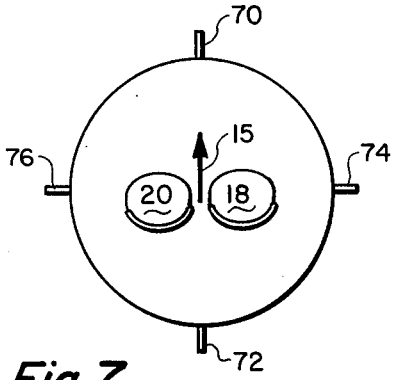
FIG. 7 illustrates an alternative arrangement of outlet pipes.

Shown in FIG. 7 is another arrangement of outlets 70 and 72 directed in the plane of the arrow 15 forward and backward with relation to the two seats 20 and 18. This can be called the fore and aft axis. There are also two outlets 74 and 76 directed at right angles to the axis 70 and 72. Thus, by setting up a jet in the opening 72, the boat would travel in the direction of the arrow 15, that is, in the fore direction, or the direction that the seats 20 and 18 are facing. By shutting the jet off in 72 and setting it up in pipe 70, the forward motion would be arrested by means of an opposing force, and the boat would then move in the direction opposite to arrow 15.

Similarly by setting up jets in either 74 or 76, the boat would move sideways to the left or to the right respectively. By a combination of jets in pipe 72 and 74, the boat would move in the direction approximately 45° to the left of arrow 15, and so on. In this way, the boat can be moved in any of eight principal directions in the direction of and at 45° to, the direction of the four principal jets.

Figure 8:
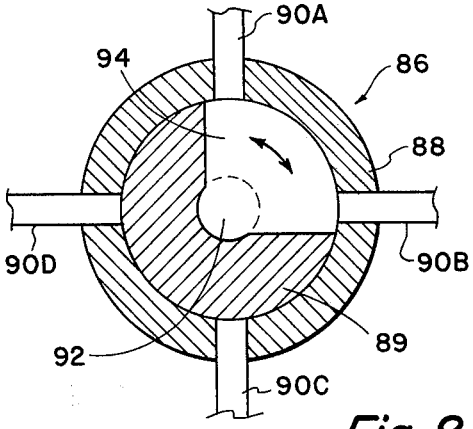
FIG. 8 illustrates a type of valve construction that can be used with the configuration of FIGS. 3 and 7.

In FIG. 8 is shown a type of rotatable valve 86 comprising a cylindrical casing 88 with say four pipes 90A, 90B, 90C, and 90D at 90° to each other. There is a cylindrical plunger 89 sealably rotatable in the casing 88. This has an axial opening 92 connected to the pump outlet, and an opening 94, 90° wide, connected to the axle opening 92.

Flow in the central opening 92 can be directed to any one, or two, of the pipes 90 by rotation of the plunger 89, in increments of 45.

By permitting axial movement of the plunger; where the plane of opening 94 is axially displaced from the plane through pipes 90, all flow can be shut off.

Figure 9:
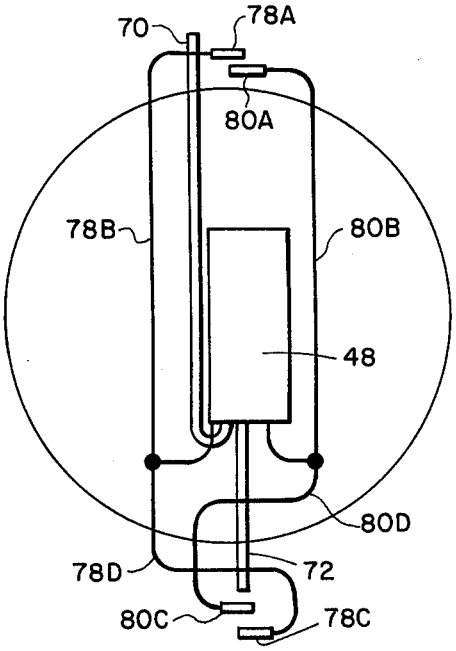
FIG. 9 illustrates an alternative system using two opposed conduits to provide jets either in one direction or in an opposite diametrical direction, plus opposed pairs of tangential pipes for providing tangential jets of water to rotate the boat about its vertical axis.

FIG. 9 shows another embodiment of the pipes, which comprises fore and aft pipes 70, 72 for backward and forward motion respectively, with the addition of two pairs (80A, 80C) of jets pipes directed tangentially for clockwise rotation, and (78A, 78B) for counterclockwise rotation. Thus the four pipes and valves of FIG. 3 can control fore and aft movement and two directions of rotation.

What has been shown is a round, nondirectional, boat that can move in any direction with an engine and pump to supply a stream of sea water at high velocity plus a plurality of pipe configurations and controls, for moving the boat in selected directions.

It will be clear, that a single tangential nozzle will provide a rotational movement about an axis. However, for rotation about an axis coinciding with the vertical axis of the boat, it is preferable to have two opposed nozzles positioned at the level of a diameter. While in FIG. 9, the diameter is indicated to be in the fore and aft direction, any diameter will do.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In a circular boat, apparatus for controlling the direction comprising;

a. a power source and liquid pump;

b. a plurality of pipes supplied with high pressure, high velocity liquid from said pump through valve means;

c. said pipes directed through the wall of said boat below the water line in selected directions;

whereby by controlling the flow of said high velocity liquid through one or more of said pipes, said boat can be controlled to move in a selected one of a plurality of predetermined directions and wherein d. each of said pipes has a valve near its discharge end;

e. each valve controlled by a separate control element;

f. each control element being a lever operating a valve by means of a tension means restrained by a spring means; and in which g. the engine throttle is responsive to the operation of at least one control element.

2. The boat as in claim 1 in which said plurality of pipes comprise four radial pipes positioned on the ends of perpendicular diameters.

3. The boat as in claim 2 in which one diameter is in the fore and aft direction.

4. The boat as in claim 2 in which both diameters are at 45° to the fore and aft dimension.

5. The boat as in claim 1 in which said plurality of pipes comprises two pipes directed respectively along a fore and aft diameter, and including:

a. at least one tangential nozzle for rotation in a counterclockwise direction; and b. at least one tangential nozzle for rotation in a counterclockwise direction.

6. The boat as in claim 5 including a pair of tangential nozzles positioned at the ends of a diameter, positioned for rotation in each direction.

* * * * *